US009668067B2

(12) United States Patent
Hug et al.

(10) Patent No.: US 9,668,067 B2
(45) Date of Patent: May 30, 2017

(54) HEARING DEVICE WITH IMPROVED LOW FREQUENCY RESPONSE AND METHOD FOR MANUFACTURING SUCH A HEARING DEVICE

(71) Applicant: Sonova AG, Stafa (CH)

(72) Inventors: Roland Hug, Hinwil (CH); Martin Rahn, Stafa (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 14/906,610

(22) PCT Filed: Jul. 22, 2013

(86) PCT No.: PCT/EP2013/065430
§ 371 (c)(1),
(2) Date: Jan. 21, 2016

(87) PCT Pub. No.: WO2015/010716
PCT Pub. Date: Jan. 29, 2015

(65) Prior Publication Data

US 2016/0157027 A1 Jun. 2, 2016

(51) Int. Cl.
*H04R 25/00* (2006.01)
*H04R 1/02* (2006.01)

(52) U.S. Cl.
CPC ..... *H04R 25/402* (2013.01); *H04R 25/48* (2013.01); *H04R 25/65* (2013.01); *H04R 25/654* (2013.01);
(Continued)

(58) Field of Classification Search
CPC ..... H04R 25/48; H04R 25/402; H04R 25/65; H04R 25/608; H04R 25/60;
(Continued)

(56) References Cited

U.S. PATENT DOCUMENTS 5,960,093 A 9/1999 Miller
2002/0196954 A1* 12/2002 Marxen ..... H04R 25/658 381/312
(Continued)

FOREIGN PATENT DOCUMENTS

DE 10-2006-007032 A1 8/2007
DE 10-2008-038213 B3 10/2009
(Continued)

OTHER PUBLICATIONS

International Search Report for PCT/EP2013/065430 dated Dec. 2, 2013.
Written Opinion for PCT/EP2013/065430 dated Dec. 2, 2013.

*Primary Examiner* — Sunita Joshi
(74) *Attorney, Agent, or Firm* — Pearne & Gordon LLP

(57) ABSTRACT

A hearing device for being worn at least partly within an ear canal. A shell encloses a cavity with a first sound opening and a second sound opening and has a receiver within the cavity. The receiver is divided into a front chamber and a back chamber by a membrane, wherein the front chamber is in acoustic communication with the exterior of the shell via the first sound opening, and the back chamber is in acoustic communication with the exterior of the shell via the second sound opening. Furthermore, a method for manufacturing such a hearing device is given.

13 Claims, 4 Drawing Sheets

(52) U.S. Cl.
CPC ..... *H04R 25/658* (2013.01); *H04R 25/60* (2013.01); *H04R 2225/021* (2013.01); *H04R 2225/023* (2013.01); *H04R 2225/025* (2013.01); *H04R 2225/43* (2013.01); *H04R 2225/77* (2013.01); *H04R 2460/09* (2013.01)

(58) Field of Classification Search
CPC ..... H04R 2460/17; H04R 1/1075; H04R 2225/025; B29C 43/00; B29C 45/00; B29C 47/00; B29C 49/00
USPC ..... 381/351, 312, 324, 328, 417, 418
See application file for complete search history.

(56) References Cited

U.S. PATENT DOCUMENTS

| | | | | |
|---|---|---|---|---|
| 2005/0002540 | A1 | 1/2005 | Vonlanthen | |
| 2009/0296971 | A1* | 12/2009 | Saltykov ..... | H04R 1/2842 381/351 |

FOREIGN PATENT DOCUMENTS

| | | | |
|---|---|---|---|
| EP | 0 548 580 | B1 | 6/1993 |
| EP | 0 455 203 | B1 | 5/1995 |
| EP | 0 851 710 | A1 | 7/1998 |
| EP | 1 209 948 | B1 | 5/2002 |
| WO | 95/07014 | A1 | 3/1995 |

* cited by examiner

HEARING DEVICE WITH IMPROVED LOW FREQUENCY RESPONSE AND METHOD FOR MANUFACTURING SUCH A HEARING DEVICE

TECHNICAL FIELD

The present invention pertains to a small ear-level hearing device with an improved low frequency response as well as to a method for manufacturing such a hearing device.

BACKGROUND OF THE INVENTION

Small electronic hearing devices for being worn at an ear or within an ear canal of a user are becoming increasingly popular. Examples of such devices are earphones, for instance used in conjunction with personal audio/video players, gaming units and mobile phones, ear-level communication devices, active hearing protection devices, in-ear monitors as well as hearing aids, sometimes also referred to as hearing instruments or hearing prostheses. Such devices are available in a number of different styles depending on how they are worn, for instance as behind-the-ear (BTE), in the crest of the cymba, in-the-ear (ITE), in-the-canal (ITC), completely-in-canal (CIC) or hybrid BTE/ITE devices. In many applications it is preferred that the device is as inconspicuous as possible, e.g. for reasons of aesthetics and wearing comfort. This is frequently achieved by placing the device into the ear canal of the user, either partly or fully. Alternatively, the devices are designed to be small enough to fit into the crest of the cymba or to be worn entirely behind the pinna.

In order to provide an audio signal to the ear drum of the user the mentioned devices require a loudspeaker, often also referred to as a receiver, i.e. a unit that converts an electrical signal conveying an audio signal into acoustic energy in the form of sound waves (more generally referred to as an electro-acoustic transducer). Such receivers need to be very small, especially in order to fit into the ear canal of a person. Smaller receivers allow to design hearing devices which can be inserted deeper into the ear canal, e.g. into the bony portion, which provides the benefit of reduced occlusion effect. This particularly enables the design of deep-fitted CIC devices. Moreover, smaller receivers allow to design hearing devices that occlude the ear canal to a lesser extent, i.e. that leave the ear canal more open when the hearing device is inserted, providing the benefit of increased wearing comfort as well as a more natural sound perception. Especially open-fitted hybrid BTE/ITE devices, popularly referred to as receiver-in-canal (RIC) or receiver-in-the-ear (RITE) devices, benefit from such small receivers. Furthermore, also BTE devices and devices worn in the crest of the cymba profit from small receivers since it is mainly the size of the receiver that determines the degree of miniaturisation achievable for these devices.

Examples of such miniature receivers for hearing devices are disclosed in EP 0 851 710 A1, EP 1 209 948 A2, U.S. Pat. No. 5,960,093 and EP 0 548 580 A1. These receivers have a high maximum output power (MPO) at their mechanical resonance frequency, typically at around 2 to 3 kHz. Below this frequency the amplitude response of these receivers degrades by 5 to 10 dB/decade dependent on the resonance damping. Additionally, when used in an ITE hearing device with a vent, the vent increases the drop off to 40 dB/decade, when the vent not resistive, and otherwise a drop off 20 dB/decade results. Consequently, a common drawback of conventional hearing devices utilising these known miniature receivers is that the low-frequency sound components cannot be effectively reproduced.

SUMMARY OF THE INVENTION

An object of the present invention is to provide a hearing device with improved low frequency response (also referred to as low frequency transfer function), i.e. where the low frequency components are enhanced. This object is achieved by the hearing device according to claim 1.

It is a further object of the present invention to propose a method for manufacturing such a hearing device, so that the hearing device is optimally adapted to the needs of its user. This object is achieved by the method for manufacturing a hearing device according to claim 11.

Various exemplary embodiments of the hearing device as well as of the method for manufacturing are given in the dependent claims.

The present invention provides a hearing device for being worn at least partly within an ear canal, comprising a shell, enclosing a cavity with a first sound opening and a second sound opening, and having a receiver within the cavity, the receiver being divided into a front chamber and a back chamber by a membrane, wherein the front chamber is in acoustic communication with the exterior of the shell via the first sound opening, and the back chamber is in acoustic communication with the exterior of the shell via the second sound opening.

In this way, additional low frequency phase-inverted sound from the back chamber provided through the second sound opening is combined with sound from the front chamber provided through the first sound opening at the exterior of the shell, thus enhancing the reproduction of low frequency sound by the hearing device, and hence yielding an improved low frequency response of the hearing device. The resonant circuit formed by the back volume together with the connected tube yields a Helmholtz resonance at around $1/(2\pi \cdot \mathrm{sqrt}(LC))$, where L is the acoustic mass of the tube and C is the acoustic compliance of the back volume.

In an embodiment of the hearing device the receiver comprises a casing with a first sound port providing access to the front chamber and a second sound port providing access to the back chamber, wherein the first sound port is connected to the first sound opening by a first sound tube, and the second sound port is connected to the second sound opening by a second sound tube. Thereby, the dimensions of second sound tube are appropriately chosen in order to achieve a specific low frequency response of the hearing device. Instead of a separate first and second sound tube a joint "double tube" can be employed instead.

In a further embodiment of the hearing device the casing features a third sound port providing further access to the back chamber, wherein the back chamber is in acoustic communication with the cavity via the third sound port, the cavity thus forming an extension of the back chamber. In this way, the low frequency response can be further improved. Thereby, the volume of the cavity is appropriately chosen in order to achieve a specific low frequency response of the hearing device.

In an alternative embodiment of the hearing device the receiver comprises a casing with a first sound port providing access to the front chamber and a third sound port providing access to the back chamber, wherein the first sound port is connected to the first sound opening by a first sound tube, and the back chamber is in acoustic communication with the cavity via the third sound port, the cavity thus forming an extension of the back chamber, and wherein the cavity is in acoustic communication with the exterior of the shell via a third sound tube, one end of the third sound tube being connected to the second sound opening, and another end of the third sound tube being located within the cavity. Thereby, the dimensions of third sound tube are appropriately chosen in order to achieve a specific low frequency response of the hearing device. Here too, a combined "double tube" can be employed instead of a separate first and third sound tube.

In a further embodiment of the hearing device the first sound opening and the second sound opening are covered by a wax protection element (also referred to as a wax guard). In this way, sweat and debris such as ear wax is kept from entering the first and second sound openings. For instance the first sound opening and the second sound opening are jointly covered by the wax protection element, or alternatively the first sound opening is covered by a first wax protection element and the second sound opening is covered by a second wax protection, i.e. each is covered separately.

In another alternative embodiment of the hearing device the receiver comprises a casing with a first sound port providing access to the front chamber and a third sound port providing access to the back chamber, wherein the first sound port is connected to the first sound opening by a first sound tube, and the back chamber is in acoustic communication with the cavity via the third sound port, the cavity thus forming an extension of the back chamber, and wherein the cavity is in acoustic communication with the exterior of the shell via a venting canal formed integrally with the shell, a first end of the venting canal forming the second sound opening of the cavity, and a second end of the venting canal forming a further sound opening to the exterior of the shell.

In a further embodiment of the hearing device an acoustic filter is arrange at the first end of the venting canal. In this way, the frequency response of the hearing device can be further adapted to the needs of the user.

In a further embodiment the hearing device is an in-the-ear, in-the-canal, or completely-in-canal hearing device or a multi-part (e.g. hybrid BTE/ITE) hearing device, the latter comprising of an outside the ear canal part and an in-the-ear, in-the-canal or completely-in-canal part comprising the receiver.

In a further embodiment of the hearing device an inner diameter $d_2$ and a length $l_2$ of the second sound tube are configured such that a balancing of the resonance frequencies of the vent effect, bass reflex and the mechanical resonance frequency is achieved. A good choice for the case without a vent is to configure the second sound tube such that the relevant frequency is amplified most, and for the case with a vent is to configure the second sound tube such that the relevant frequency is located above the vent resonance in order to increase the output power between the vent and mechanical resonance, or below the vent resonance in order to extend the bandwidth towards low frequencies. Increasing the back volume by an extended back volume allows to decrease the length of the tubing. As an example, a back volume of 0.5 ccm and a tube of length 12 mm with a diameter of 1 mm yields a resonance at about 600 Hz.

In a further embodiment of the hearing device an inner diameter $d_3$ and a length $l_3$ of the third sound tube are configured such that a balancing of the resonance frequencies of the vent effect, bass reflex and the mechanical resonance frequency is achieved.

In a further embodiment the multi-part (e.g. hybrid BTE/ITE) hearing device is adapted to provide an open fitting. In this way, the venting canal of the hearing device with a sealed, i.e. closed fitting is replaced by a sound path that bypasses the in-ear part of the hearing device along its periphery.

In order to be able to tailor the hearing device to the specific needs of a user and to fully optimise its sound performance to the user's individual requirements an appropriate method for manufacturing such a hearing device according to the present invention is required.

The present invention thus further provides a method for manufacturing a hearing device according to the present invention comprising the steps of:

- measuring at least a portion of an inner shape of an ear canal of a user of the hearing device;
- generating a three-dimensional computer model of:
  - the shell, such that the shell has an outer surface individually shaped according to the measured inner shape of a section of the user's ear canal;
  - the cavity;
  - the receiver; and
  - at least one of the following elements:
    - a) the second sound opening;
    - b) the second sound port;
    - c) the second sound tube;
    - d) the third sound port;
    - e) the third sound tube or a part thereof;
    - f) the venting canal;
    - g) the further sound opening; and
- computing acoustic properties of the hearing device based on the generated three-dimensional computer model;
- modifying the three-dimensional computer model if the computed acoustic properties deviate from desired acoustic properties by modifying at least one of shape, cross-section, length, inner diameter and location of at least one of the elements a) to g).

In an embodiment of the manufacturing method the step of computing is further based on the measured inner shape of the user's ear canal.

In a further embodiment of the manufacturing method the step of computing takes into account a rest volume of the ear canal remaining between the shell of the hearing device and an ear drum of the user when the shell is inserted into the user's ear canal. Preferably, also the middle ear compliance is taken into account, specifically the air volume behind the ear drum, i.e. the air volume in the middle ear.

In a further embodiment of the manufacturing method the steps of computing and modifying are repeated until the computed acoustic properties match the desired acoustic properties.

In a further embodiment the manufacturing method the computed acoustic properties include one or more of an acoustic impedance, an acoustic compliance, a frequency response, a resonant frequency, a power conversion efficiency, an output sound pressure level.

It is pointed out that combinations of the above-mentioned embodiments give rise to even further, more specific embodiments according to the present invention.

BRIEF DESCRIPTION OF THE DRAWINGS

The present invention is further explained below by means of non-limiting specific embodiments and with reference to the accompanying drawings, which show.

In the figures, like reference signs refer to like parts or components.

DETAILED DESCRIPTION OF THE INVENTION

Figure 1:
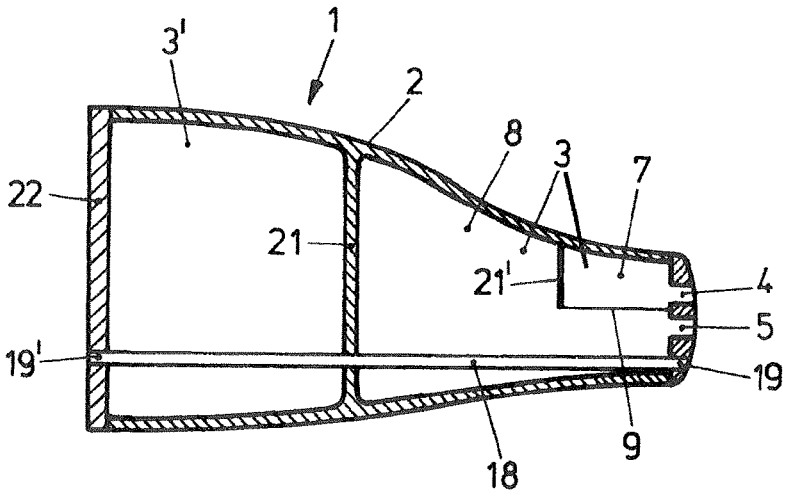
FIG. 1 a schematic illustration of a first exemplary embodiment of a hearing device according to the present invention.

A first embodiment of a hearing device 1 according to the present invention is illustrated schematically in FIG. 1. The hearing device 1 shown in FIG. 1 is intended to be worn at least partly within an ear canal. As such it can be an ITE, ITC or CIC hearing device or the in-ear part of a multi-part hearing device, e.g. the ITE portion of a hybrid BTE/ITE hearing device. The hearing device 1 comprises a shell 2, which encloses a cavity 3 located at the proximal end of the hearing device 1 and a further cavity 3' located at the distal end of the hearing device 1, whereby the two cavities 3 and 3' are separated from one another by a wall 21, which preferably seals off the cavities 3 and 3' from one another. The cavity 3 is subdivided into a front chamber 7 and a back chamber 8 by means of a further wall 21' and a membrane 9 (also referred to as a diaphragm). The front and back chambers 7 and 8, the membrane 9 and a motor assembly (not shown) connected to the membrane 9 for instance by means of a pin (not shown) form a receiver which converts an audio representing electrical signal into sound. The sound generated within the front chamber 7 is provided to the exterior of the shell 2 via a first sound opening 4. According to the present invention also low frequency sound generated in the back chamber 8 is provided to the exterior of the shell 2, namely via a second sound opening 5. The low frequency sound originating from the back chamber 8 is phase-inverted relative to the sound originating from the front chamber 7, so the superposition of both boosts the low frequency sound generated by the hearing device 1. The low frequency response of the hearing device 1 may be adapted to the specific requirements of the user by appropriately configuring the volume of the back chamber 8 as well as the size of the second opening 5. The presence of a venting canal 18 (also referred to simply as a vent) further influences the low frequency characteristics of the hearing device 1. The venting canal 18 traverses the hearing device 1 from a further sound opening 19 at the proximal end of the hearing device 1 to another sound opening 19' at the distal end, and thus especially provides ventilation as well as pressure equalisation of the inner portion of the ear canal to outside the ear when the hearing device 1 is being worn.

In the first embodiment according to FIG. 1, the shell 2 acts as an encapsulation of the receiver. An alternative, second embodiment of a hearing device 1 according to the present invention is illustrated schematically in FIG. 2*a*). Here the receiver 6 is arranged within the cavity 3 as a separate module or unit with a casing 10. A first sound port 11 in the casing 10 of the receiver 6 providing access to the front chamber 7 of the receiver 6 is connected with the first sound opening 4 of the cavity 3 via a first sound tube 13. A second sound port 12 in the casing 10 of the receiver 6 providing access to the back chamber 8 of the receiver 6 is connected with the second sound opening 5 of the cavity 3 via a second sound tube 14. The length $l_2$ and inner diameter $d_2$ (cross-section) of the second sound tube 14 also influence the low frequency response of the hearing device 1 (as does also the compliance of the back volume), and are preferably appropriately configured to optimally adapt the acoustical characteristics of the hearing device 1, especially the resonance frequency of the receiver, to the specific needs of the user. The second sound tube 14 for example has an inner diameter $d_2$ in the range from 0.8 mm to 2 mm and a length $l_2$ of 12 mm. The first and second sound openings 4 and 5 are for instance covered by a wax protection element 17 (also referred to as wax guard) in order to prevent sweat and dirt such as ear wax from entering into the first and second sound tubes 13 and 14, thus avoiding them getting clogged. Optionally, a third sound port 15 can be provided in the casing 10 of the receiver 6 providing further access to the back chamber 8 of the receiver 6. In this way, the cavity 3 acts as an extension of the back chamber, thus substantially increasing the overall back volume of the receiver 6. This also influences the low frequency response of the hearing device 1, so that by appropriately configuring the size of the cavity 3 the acoustical characteristics of the hearing device 1 can be optimally adapted to the needs of the user.

Figure 2A:
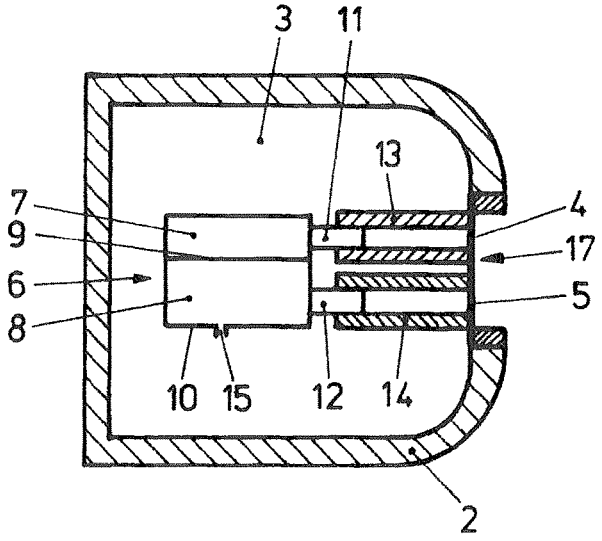
FIG. 2*a* a schematic illustration of a second exemplary embodiment of a hearing device according to the present invention.
Figure 2B:
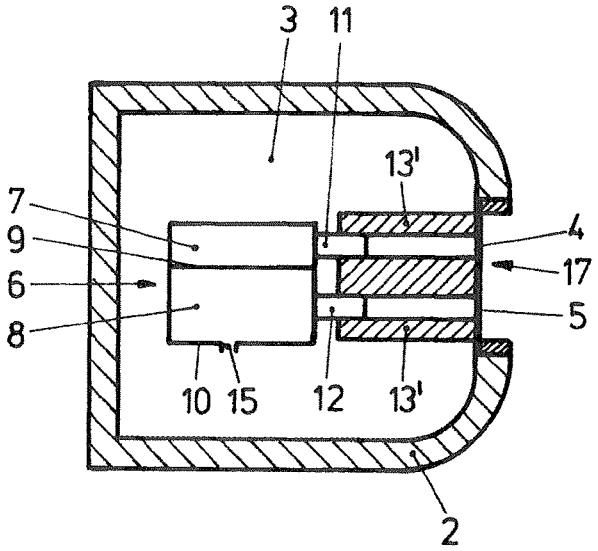
FIG. 2*b* a schematic illustration of a special variant of the second exemplary embodiment of a hearing device according to the present invention.

FIG. 2*b*) illustrates a variant of the embodiment shown in FIG. 2*a*) where a joint or combined "double tube" 13' is utilised instead of separate first and second sound tubes 13 and 14.

Figure 3:
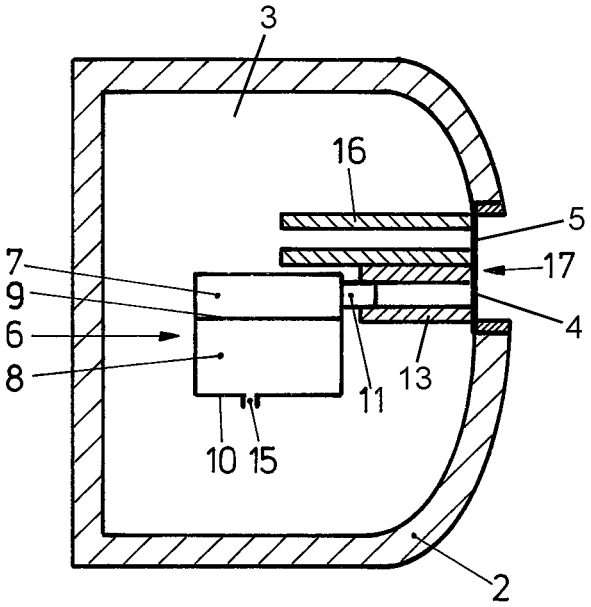
FIG. 3 a schematic illustration of a third exemplary embodiment of a hearing device according to the present invention.

Another alternative, third embodiment of a hearing device 1 according to the present invention is illustrated schematically in FIG. 3. Here, the second sound port 12 included in the second embodiment is omitted, but instead the third sound port 16 is now mandatory. Furthermore, a third sound tube 16 is connected to the second sound opening 5 of the cavity 3, which acts as an extension of the back chamber 8 of the receiver 6, thus enlarging the overall back volume of the receiver. Sound then exits from the cavity 3 through this third sound tube 16, which functions as a low pass filter (together with the back volume compliance which act as a high pass). Hence, the third sound tube 16 too influences the low frequency response of the hearing device 1, so that by appropriately configuring the length $l_3$ and inner diameter $d_3$ (cross-section) of the third sound tube 16 the acoustical characteristics of the hearing device 1 can be optimally adapted to the needs of the user. The third sound tube 16 for example has an inner diameter $d_3$ in the range from 0.8 mm to 2 mm and a length $l_3$ of 12 mm, such that the resonance frequency of the hearing device transducer output is located at about 600 Hz for the case of $d_3$=1 mm. Alternatively or additionally, an acoustic filter element can be arranged at either end of the third sound tube 16 in order to further influence the frequency response of the hearing device 1. Moreover, a solution is also possible employing an extended double tube or two extended separate tubes.

Figure 4:
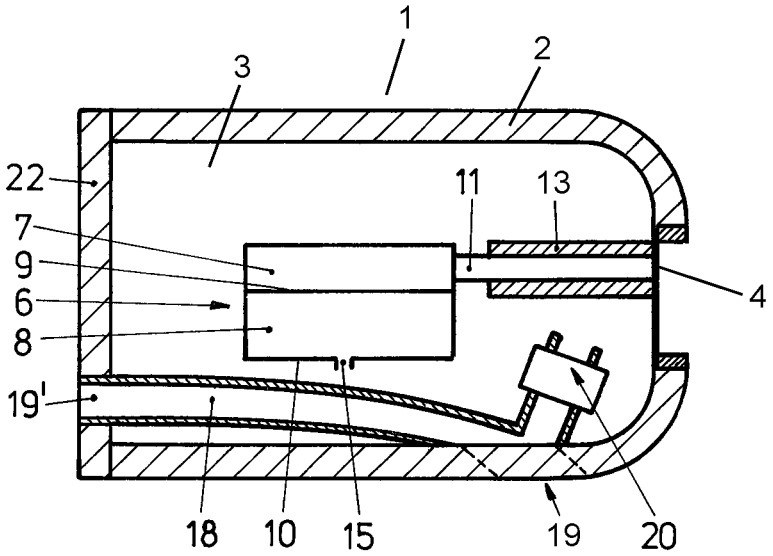
FIG. 4 a schematic illustration of a fourth exemplary embodiment of a hearing device according to the present invention.

A further alternative, fourth embodiment of a hearing device 1 according to the present invention is illustrated schematically in FIG. 4. Here, the third sound tube 16 of the third embodiment is replaced with a feed into a venting canal 18, the proximal end 19 of the venting canal 18 forming the second sound opening 5 of the cavity 3. The distal end 19' of the venting canal 18 for instance is located at a face plate 22 of the hearing device 1 (cf. FIG. 1). This fourth embodiment also requires that the casing 10 of the receiver 6 features a third sound port 15 providing access to the back chamber 8. The cavity 3 also acts as an extension of the back chamber 8, thus enlarging the overall back volume of the receiver 6. The venting canal 18 allows sound from the cavity 3 to exit to the exterior of the shell 2 through the proximal end 19, i.e. the second sound opening 5 of the cavity 3. The inner diameter $d_v$ of the venting canal 18 influences the low frequency response of the hearing device 1, so that the acoustical characteristics of the hearing device 1 can be optimally adapted to the needs of the user by appropriately configuring the inner diameter $d_v$ (cross-section) of the venting canal 18. Optionally, an acoustic filter 20 can be arranged at the feed into the venting canal 18 in order to further influence the low frequency response of the hearing device 1. Preferably, a tube should be arranged at the feed into the venting canal 18 in order to avoid short-circuiting the back volume.

Figure 5:
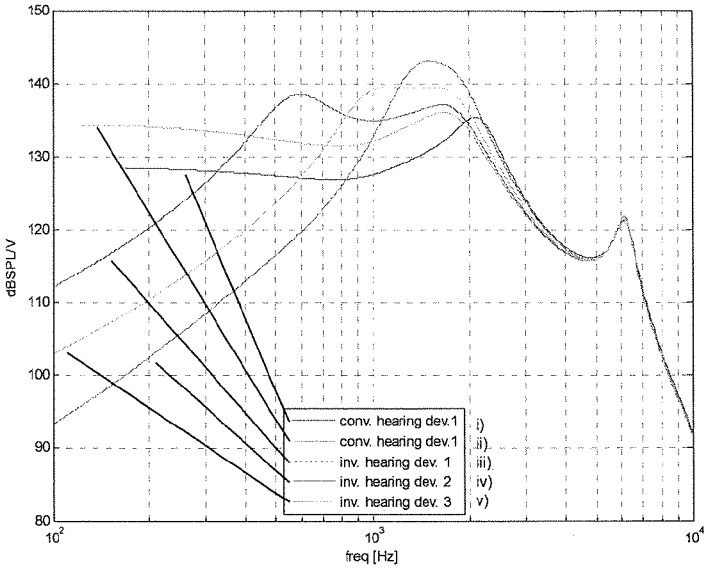
FIG. 5 plots of the amplitude response of a conventional hearing device and of hearing devices according to the present invention.

FIG. 5 show plots of the amplitude response of a conventional hearing device and three hearing devices according to the present invention, all without a venting canal, in order to demonstrate the improvements achievable by hearing devices according to the present invention. In all cases the same receiver model, i.e. a Sonion 31A015, is employed. The first trace i) was derived using a conventional hearing device without an extended back volume. The second trace ii) was derived using a conventional hearing device employing an extended back volume. The third iii) was derived using a first hearing device according to the present invention employing an extended back volume of 0.5 ccm and a third sound tube 16 having an inner diameter of $d_{3,1}$=0.8 mm and a length of $l_3$=12 mm. The fourth trace iv) was derived using a second hearing device according to the present invention employing an extended back volume of 0.5 ccm and a third sound tube 16 having a different inner diameter of $d_{3,2}$=2 mm and the same length of $l_3$=12 mm. The fifth trace v) was derived using a third hearing device according to the present invention employing an extended back volume of 0.5 ccm and a third sound tube 16 having yet another inner diameter of $d_{3,3}$=1.4 mm and the same length of $l_3$=12 mm. As can be seen the low frequency response of the hearing devices according to the present invention are boosted considerably compared to the conventional hearing device, whereby the amplitude response then drops of with an additional 20 dB/decade below the boosted frequency range.

Figure 6:
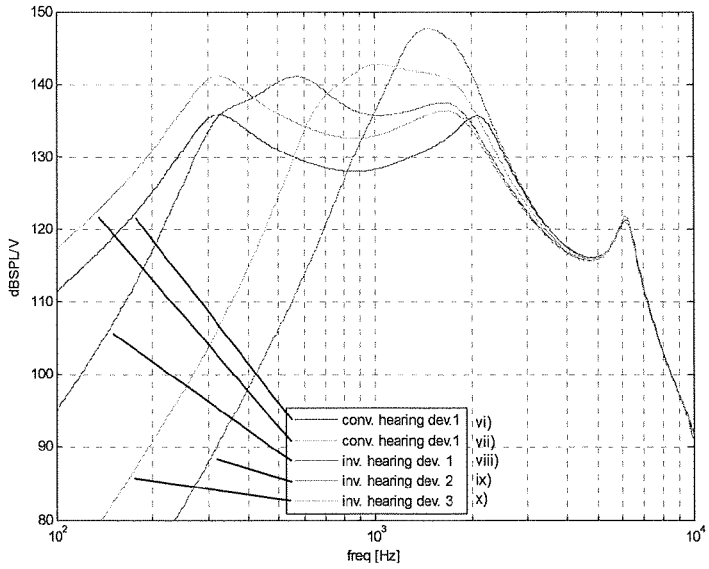
FIG. 6 further plots of the amplitude response of conventional hearing devices and of hearing devices according to the present invention.

FIG. 6 show plots of the amplitude response of two conventional hearing devices and three more hearing devices according to the present invention, all with a venting canal, in order to further demonstrate the improvements achievable by hearing devices according to the present invention. The sixth trace vi) was derived using a conventional hearing device with a venting canal having a diameter of 1 mm. The seventh trace vii) was derived using a conventional hearing device with a venting canal having a diameter of 1 mm and employing an extended back volume. The eighth trace viii) was derived using another first hearing device according to the present invention with a venting canal having a diameter of 1 mm and employing an extended back volume of 0.5 ccm and a third sound tube 16 having an inner diameter of $d_{3,1}$=0.8 mm and a length of $l_3$=12 mm. The ninth trace ix) was derived using another second hearing device according to the present invention with a venting canal having a different diameter of 2 mm and employing an extended back volume of 0.5 ccm and a third sound tube 16 having an different inner diameter of $d_{3,2}$=2 mm and the same length of $l_3$=12 mm. The tenth x) was derived using another third hearing device according to the present invention with a venting canal having yet another diameter of 3 mm and employing an extended back volume of 0.5 ccm and a third sound tube 16 having yet another inner diameter of $d_{3,3}$=1.4 mm and the same length of $l_3$=12 mm. As can be seen the low frequency response of the hearing devices according to the present invention is boosted considerably compared to the conventional hearing devices, whereby the low frequencies are boosted additionally by the venting canal in these examples.

Similarly to a hearing device 1 featuring a venting canal 18, a hearing device with an open fitting can be employed together with the present invention, where in the latter case the in-ear part of the hearing device does not seal off the ear canal but allows direct sound from outside the ear to bypass the in-ear part of the hearing device and reach the user's ear drum. Such "open fit" hearing devices exhibit no or at least a strongly reduced occlusion effect, since low frequency sound can pass freely in and out of the ear canal when the hearing device is being worn.

A further aspect of the present invention pertains to a method for manufacturing the hearing device according to the present invention, whereby especially the shell 2, the second sound tube 14 and the volume of the cavity 3 acting as an extension of the back chamber 8 as well as the venting canal 18 are dimensioned by means of a rapid shell modelling (RSM) software in order to optimise the overall frequency response of the hearing device 1 individually to the needs of the user, e.g. dependent on the hearing loss of the user.

Instead of optimising the dimensions of the tube by means of rapid shell modelling, a rubber tube could be taken and cut to the required dimensions. This applies to both single and double tubes, e.g. with a double tube 13' (cf. FIG. 2*b*)) instead of separate first and second sound tubes 13, 14 (cf. FIG. 2*a*)) or for only one of the two tubes 13 or 14.

The invention claimed is:

1. A hearing device (1) for being worn at least partly within an ear canal, comprising a shell (2) enclosing a cavity (3) with a first sound opening (4) and a second sound opening (19), and having a receiver (6) within the cavity (3), the receiver (6) being divided into a front chamber (7) and a back chamber (8) by a membrane (9), wherein the receiver (6) comprises a casing (10) with a first sound port (11) providing access to the front chamber (7) and a third sound port (15) providing access to the back chamber (8), and wherein the front chamber (7) is in acoustic communication with the exterior of the shell (2) via the first sound opening (4) connected to the first sound port (11) by a first sound tube (13), and wherein the back chamber (8) is in acoustic communication with the cavity (3) via the third sound port (15), the cavity (3) forming an extension of the back chamber (8), and wherein the cavity (3) is in acoustic communication with the exterior of the shell (2) via a canal (18) formed integrally with the shell (3), a first end (19) of the canal (18) forming the second sound opening (19), and a second end of the canal (18) forming a further sound opening (19') to the exterior of the shell (2), and wherein said canal (18) is configured as a venting canal (18) providing ventilation as well as pressure equalization of the inner portion of the ear canal to outside the ear when the hearing device (1) is being worn.

2. The hearing device (1) of claim 1, wherein the casing (10) comprises a second sound port (12) providing further access to the back chamber (8), and wherein the second sound port (12) is connected to a third sound opening (5) by a second sound tube (14).

3. The hearing device (1) of claim 1, wherein the cavity (3) is in further acoustic communication with the exterior of the shell (2) via a third sound tube (16), one end of the third sound tube (16) being connected to a third sound opening (5), and another end of the third sound tube (16) being located within the cavity (3).

4. The hearing device (1) of claim 2, wherein the first sound opening (4) and the third sound opening (5) are covered by a wax protection element (17), wherein for instance the first sound opening (4) and the third sound opening (5) are jointly covered by the wax protection element (17), or alternatively wherein the first sound opening (4) is covered by a first wax protection element and the third sound opening (5) is covered by a second wax protection, each separately.

5. The hearing device (1) of claim 1, wherein an acoustic filter (20) is arranged at the first end of the canal (18).

6. The hearing device (1) of claim 1, wherein the hearing device (1) is an in-the-ear, in-the-canal, or completely-in-canal hearing device or a multi-part hearing device, the latter comprising an outside the ear canal part and an in-the-ear, in-the-canal or completely-in-canal part comprising the receiver (6).

7. The multi-part hearing device of claim 6, adapted to provide an open fitting.

8. A method for manufacturing a hearing device (1) according to claim 1 comprising the steps of:

measuring at least a portion of an inner shape of an ear canal of a user of the hearing device (1);

generating a three-dimensional computer model of:

the shell (2), such that the shell (2) has an outer surface individually shaped according to the measured inner shape of a section of the user's ear canal;

the cavity (3);

the receiver (6); and at least one of the following elements:

a) a third sound opening (5);

b) the second sound port (12);

c) the second sound tube (14);

d) the third sound port (15);

e) the third sound tube (16);

f) the venting canal (18);

g) the second sound opening (19); and h) the further sound opening (19'), computing acoustic properties of the hearing device (1) based on the generated three-dimensional computer model; and modifying the three-dimensional computer model if the computed acoustic properties deviate from desired acoustic properties by modifying at least one of shape, cross-section, length, inner diameter and location of at least one of the elements a) to h).

9. The method of claim 8, wherein the step of computing is further based on the measured inner shape of the user's ear canal.

10. The method of claim 8, wherein the step of computing takes into account a rest volume of the ear canal remaining between the shell (2) of the hearing device (1) and an ear drum of the user when the shell (2) is inserted into the user's ear canal, and preferably also takes into account the user's middle ear compliance.

11. The method of claim 8, wherein the steps of computing and modifying are repeated until the computed acoustic properties match the desired acoustic properties.

12. The method of claim 8, wherein the computed acoustic properties include one or more of an acoustic impedance, an acoustic compliance, a frequency response, a resonant frequency, a power conversion efficiency, an output sound pressure level.

13. The hearing device (1) of claim 1, wherein a further sound tube is arranged at the first end (19) of the canal (18).

* * * * *